US005563561A

United States Patent [19]

Ishihara et al.

[11] Patent Number: 5,563,561

[45] Date of Patent: Oct. 8, 1996

[54] DIELECTRIC BLOCK APPARATUS HAVING TWO OPPOSING COAXIAL RESONATORS SEPARATED BY AN ELECTRODE FREE REGION

[75] Inventors: Jisei Ishihara; Shuuichi Sakai, both of Ishikawa, Japan

[73] Assignee: Murata Manufacturing Co., Ltd., Japan

[21] Appl. No.: 390,452

[22] Filed: Feb. 17, 1995

[30] Foreign Application Priority Data

Feb. 17, 1994 [JP] Japan ..... 6-020309

[51] Int. Cl.[6] ..... H01P 1/202

[52] U.S. Cl. ..... 333/206; 333/222

[58] Field of Search ..... 333/202, 206, 333/222, 223

[56] References Cited

U.S. PATENT DOCUMENTS

| | | | |
|---|---|---|---|
| 4,151,494 | 4/1979 | Nishikawa et al. | 333/206 X |
| 4,245,198 | 1/1981 | Nishikawa et al. | 333/206 X |

FOREIGN PATENT DOCUMENTS

| | | | |
|---|---|---|---|
| 4103203 | 4/1992 | Japan | 333/202 DB |
| 5183309 | 7/1993 | Japan | 333/202 DB |
| 2276041 | 9/1994 | United Kingdom | 333/206 |

OTHER PUBLICATIONS

Hano et al., "A Bandpass Filter Using Direct-Coupled Quarter Wavelength Coaxial Dielectric Resonators," *Microwave Journal*, Nov. 1987, pp. 141–160.

*Primary Examiner*—Benny Lee
*Assistant Examiner*—Justin P. Bettendorf
*Attorney, Agent, or Firm*—Majestic, Parsons, Seibert & Hsue

[57] ABSTRACT

A compact multi-stage dielectric resonator apparatus is formed either by placing two or more axially elongated inner conductors axially separated from each other inside a throughhole through a dielectric block such that the mutually separated inner conductors are coupled capacitively across an electrode-free region which separates them and a multi-stage resonator is thereby formed, or by attaching a plurality of single-stage dielectric resonators to such a multi-stage resonator to form a unistructural apparatus. Each of these single-stage dielectric resonators has a dielectric block with a throughhole containing an axially extending inner conductor. Outer surfaces of the resonators are substantially entirely covered by outer conductors but openings in the outer conductor and coupling-providing conductors insulated from and entirely surrounded by the outer conductor are provided for magnetically and electrostatically coupling the resonators which are attached together. Signal input-output terminals separated from and surrounded by the outer conductors may also be provided for easy mounting of the apparatus on a circuit board.

20 Claims, 10 Drawing Sheets

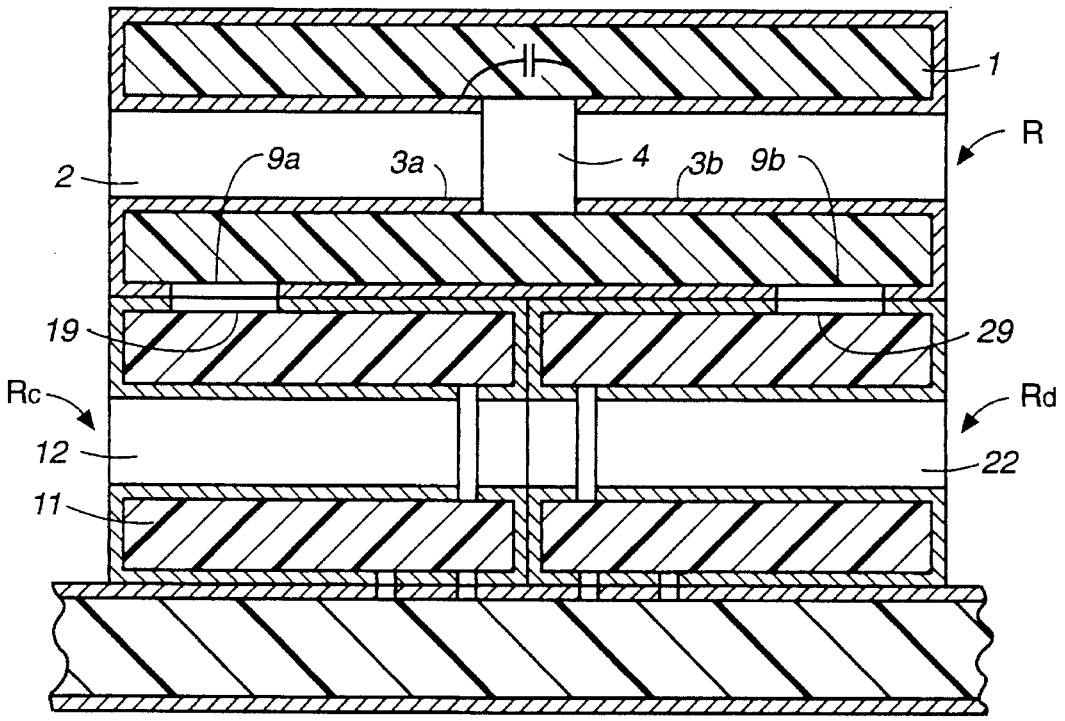
FIG._15
FIG._16
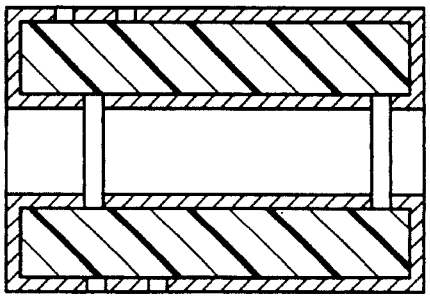
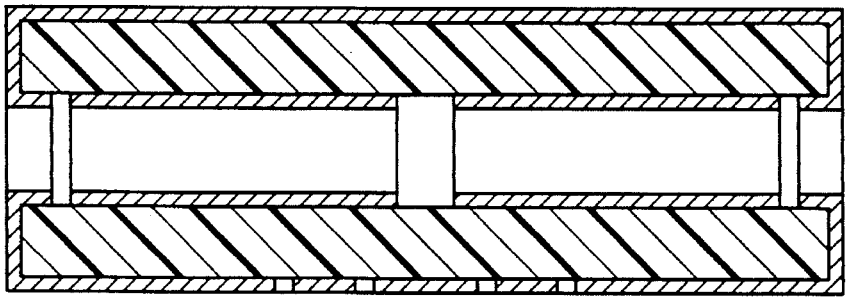
FIG._17

DIELECTRIC BLOCK APPARATUS HAVING TWO OPPOSING COAXIAL RESONATORS SEPARATED BY AN ELECTRODE FREE REGION

BACKGROUND OF THE INVENTION

This invention relates to dielectric resonator apparatus having a plurality of dielectric resonators formed inside a dielectric block. This invention also relates to dielectric resonator apparatus having a plurality of such dielectric resonators formed unistructurally.

It has been known, as an example of prior art apparatus of this kind, to provide a plurality of inner electrodes serving as resonant conductors inside a dielectric block of a rectangular parallelopiped and an outer conductor on its outer surfaces to thereby produce a dielectric resonator apparatus having multi-stage resonators. Such unistructurally formed dielectric resonator apparatus are convenient because they do not require a shielding case or brackets for attaching to a circuit board and can be surface-mounted easily.

For producing dielectric resonator apparatus having different numbers of resonators in a dielectric block, however, it was necessary to provide many different kinds of molds. In other words, many molds had to be prepared for producing dielectric resonator apparatus with various characteristics and this affected their production costs adversely. Moreover, since the distances between the resonators are determined by the dimensions and the shapes of the molds, it was difficult to accurately set the degree of coupling between the resonators. In the case of a prior art combine-type dielectric resonator apparatus, for example, the setting or adjustment of the degree of coupling between the resonators was intimately related to that of the resonance frequencies of the individual resonators such that a change in one would affect the other and hence that it was difficult to set or adjust both of them independently. Since a plurality of mutually parallel inner conductors are arranged inside a single dielectric block, furthermore, the external dimension of the dielectric block will increase in the direction in which these inner conductors are arranged as the number of stages is increased. This reduces the degree of freedom in making connections to connector terminals when it is mounted to a circuit board.

SUMMARY OF THE INVENTION

It is therefore an object of this invention to provide dielectric resonator apparatus with which the problems described above, arising when a plurality of inner conductors are arranged mutually parallel inside a dielectric block, can be solved.

It is another object of this invention to provide dielectric resonator apparatus which do not require a shielding case or mounting brackets.

It is still another object of this invention to provide such dielectric resonator apparatus which can be made compact and manufactured at a lower production cost without providing molds individually for different kinds of resonators.

It is a further object of this invention to provide such dielectric resonator apparatus of which the resonant frequencies of the individual resonators and the degrees of coupling between them can be independently set and adjusted.

It is a still further object of this invention to provide such dielectric resonator apparatus which require only a small area on a circuit board for mounting even if the number of stages of the resonators is increased.

Dielectric resonator apparatus according to one embodiment of this invention, with which the above and other objects can be accomplished, may be characterized as comprising a dielectric block having mutually opposite first and second end surfaces, side surfaces extending between these end surfaces and an axially elongated cavity extending internally between the first and second end surfaces, an outer conductor covering at least the side surfaces of the dielectric block, and a plurality of inner conductors which are axially extending inside the cavity to each serve as a resonating conductor and are mutually separated axially from each other with gaps serving as conductor-free or electrode-free regions provided in between such that mutually adjacent pairs of the inner conductors are coupled together electrostatically across these electrode-free regions. Signal input/output terminals may be provided on a side surface of the dielectric block for connection to signal lines on a circuit board when the apparatus is mounted thereto. A capacitance can then be generated between such terminals and the inner conductor. With a plurality of inner conductors thus arranged axially, the freedom of choice in the design of the apparatus increases when, for example, such signal input/output terminals are formed. If both end surfaces of the dielectric block are covered by the outer conductor to form what are referred to as "short-circuit end surfaces", unwanted emission of waves from inside as well as introduction of unwanted external waves into the throughhole can be prevented. If an open-circuit end, not contacting any other conductor, of an inner conductor is to be near an end surface of the dielectric block, it can be formed by inserting a rotary grindstone from the end surface and removing not only a portion of the inner conductor but also a portion of the dielectric material of the block. Thus, such an open-circuit end can be formed easily, and both the axial length of the inner conductor and the stray capacitance at the open-circuit end of the inner conductor can be easily adjusted.

Dielectric resonator apparatus of another type according to this invention, with which the above and other objects can be accomplished, may be characterized as having a plurality of dielectric resonators each having a single resonant inner conductor and serving as a single-stage resonator unistructurally attached to and coupled with a dielectric resonator of the kind described above. Coupling may be through coupling-providing conductors formed on side surfaces of the mutually attached dielectric resonators, separated from the outer conductors covering the outer side surfaces of the dielectric blocks of the coupled resonators. The coupling may be magnetic and effected through openings through the outer conductors of the resonators which are attached to each other. Since these individual resonators are connected together through their side surfaces, compact multi-stage apparatus can thus be formed easily.

BRIEF DESCRIPTION OF THE DRAWINGS

The accompanying drawings, which are incorporated in and form a part of this specification, illustrate embodiments of the invention and, together with the description, serve to explain the principles of the invention. In the drawings:

FIG. 15 is a schematic sectional view of the dielectric resonator apparatus of FIG. 13 across an axially and vertically extending plane crossing it at its center;

FIG. 16 is a schematic sectional view of another type of dielectric resonator of the first kind with two open-circuit end surfaces; and FIG. 17 is a schematic sectional view of another type of dielectric resonator of the second kind with two open-circuit end surfaces.

Throughout herein, some of the components which are equivalent or substantially similar to each other are indicated by the same symbol for convenience and are not necessarily explained repetitiously.

DETAILED DESCRIPTION OF THE INVENTION

Figure 1A:
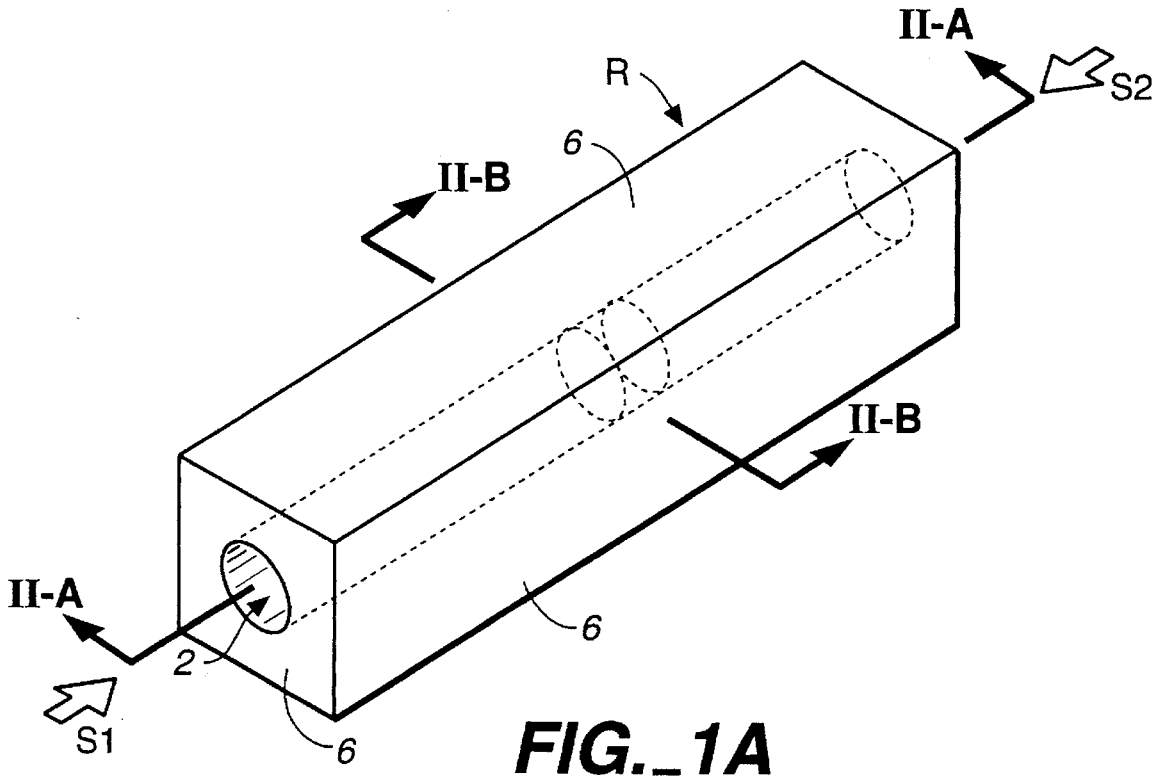
FIG. 1A is an external view of a dielectric resonator apparatus according to a first embodiment of the invention taken diagonally from above.
Figure 1B:
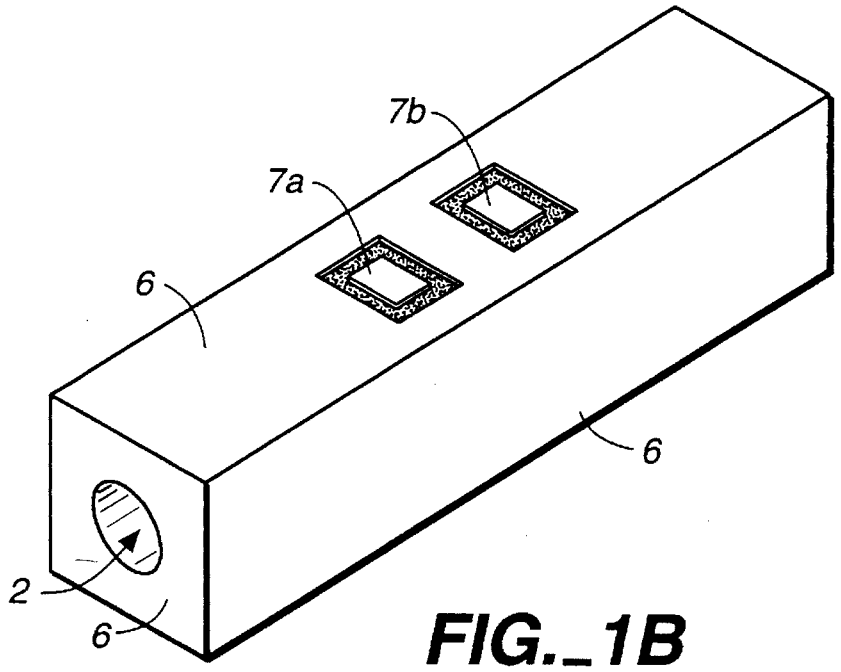
FIG. 1B is another diagonal external view of the same dielectric resonator apparatus taken diagonally from below.
Figure 2A:
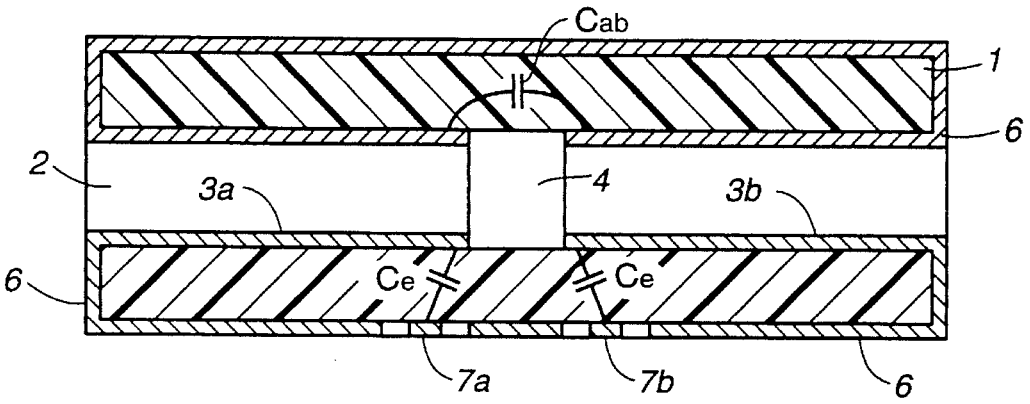
FIGS. 2A and 2B are schematic sectional views of the dielectric resonator apparatus of FIG. 1 taken respectively along lines II-A—II-A and II-B—II-B of FIG.
Figure 2B:
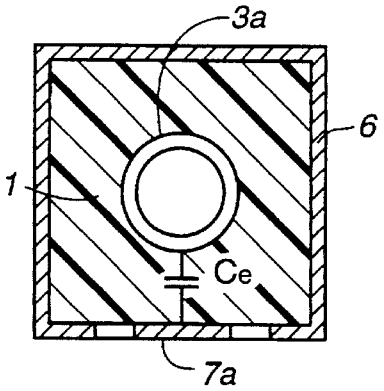
Figure 3:
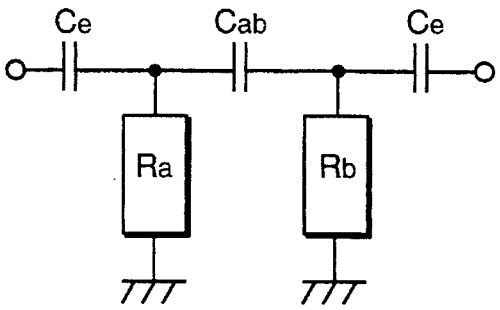
FIG. 3 is an equivalent circuit diagram of the dielectric resonator apparatus of FIG. 1.

FIGS. 1–3 show a dielectric resonator apparatus according to a first embodiment of the invention, characterized as comprising a dielectric block i in the shape of a rectangular parallelopiped having mutually opposite first and second end surfaces S1 and S2, four side surfaces extending therebetween, and a throughhole 2 extending therethrough between the first and second end surfaces S1 and S2. Two tubular inner conductors 3*a* and 3*b* are formed on the inner surface of the throughhole 2, separated from each other in the axial direction (that is, the direction of extension of the throughhole 2) by an electrode-free region 4 provided therebetween, each so as to function as a resonant conductor having a resonant frequency. An outer conductor 6 is formed substantially entirely on the externally facing surfaces of the dielectric block 1, that is, its two end surfaces S1 and S2 and the four side surfaces therebetween. On one of the side surfaces, there are two signal input/output terminals 7*a* and 7*b*, separated from but totally surrounded by the outer conductor 6 like islands. The outer conductor 6 is connected to the inner conductors 3*a* and 3*b* on the end surfaces S1 and S2. Thus, the dielectric block 1 may be said to contain two dielectric resonators, the end surfaces serving as shorted surfaces and the electrode-free region 4 defining their the open-circuit ends. Since a capacitance $C_{ab}$ is generated between the inner conductors 3*a* and 3*b* across the electrode-free region 4 (or across their open-circuit ends), the two resonators are capacitively coupled thereby. Capacitance $C_e$ is also generated between each of the signal input/output terminals 7*a* and 7*b* and open-circuit end portions of the inner conductors 3*a* and 3*b* near the electrode-free region as schematically illustrated in FIG. 2. Since the end surfaces S1 and S2 are covered by the outer conductor 6 and serve as short-circuit ends, leakage of electromagnetic field is prevented from the openings of the throughhole 2 and both unwanted radiation to the exterior and induction from the exterior are prevented. In the equivalent circuit diagram shown in FIG. 3 for the dielectric resonator apparatus of FIGS. 1 and 2, $R_a$ and $R_b$ indicate the dielectric resonators which are formed respectively with the inner conductors 3*a* and 3*b*, and together form a two-stage dielectric resonator apparatus such as a bandpass filter.

Figure 4:
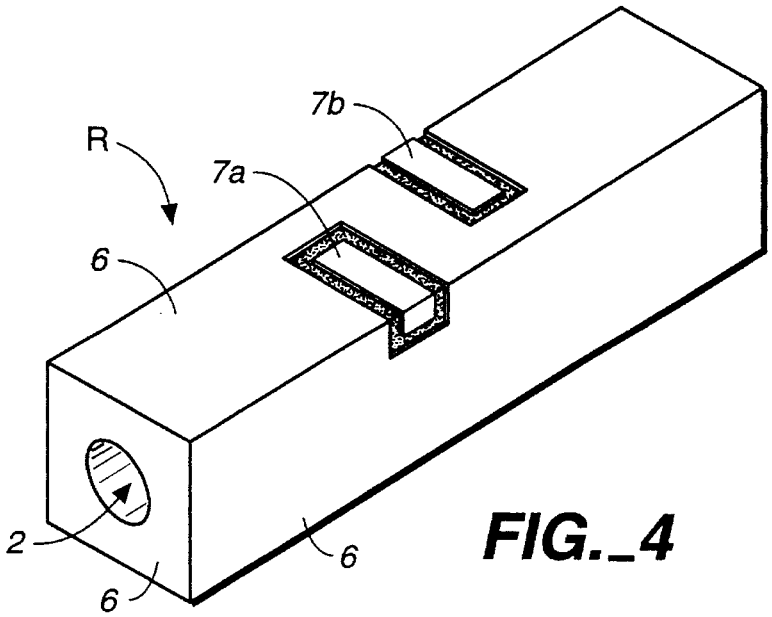
FIG. 4 is a diagonal external view of a dielectric resonator apparatus according to a second embodiment of the invention.

FIG. 4 shows another dielectric resonator apparatus according to a second embodiment of the invention, different from the one according to the first embodiment of the invention described above with reference to FIGS. 1–3 in that signal input/output terminals 7*a* and 7*b* are not formed entirely on one of the four side surfaces of the dielectric block 1 but each extend over two mutually adjacent side surfaces such that they can be more easily connected to desired terminals formed on a circuit board.

FIGS. 5–8 show still another dielectric resonator apparatus according to a third embodiment of the invention, wherein $R_c$ and $R_d$ each indicate a structure which functions as a single-stage resonator and will be referred to as a dielectric resonator of the first kind, and R indicates a structure which is essentially identical to the resonator apparatus described above with reference to FIGS. 1A and 1B and will be referred to as a dielectric resonator of the second kind. These three resonators R, $R_c$ and $R_d$ are attached together to form a unistructural apparatus as shown in FIGS. 5A and 5B.

Figure 5A:
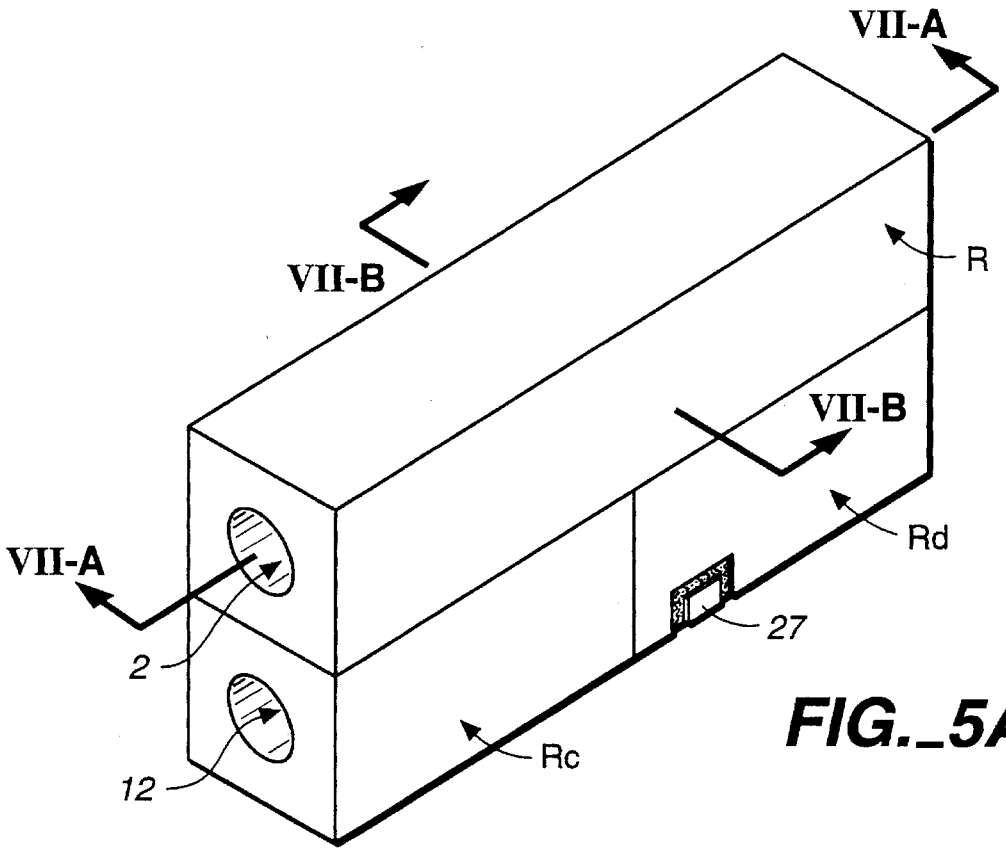
FIG. 5A is an external view of a dielectric resonator apparatus according to a third embodiment of the invention taken diagonally from above.
Figure 5B:
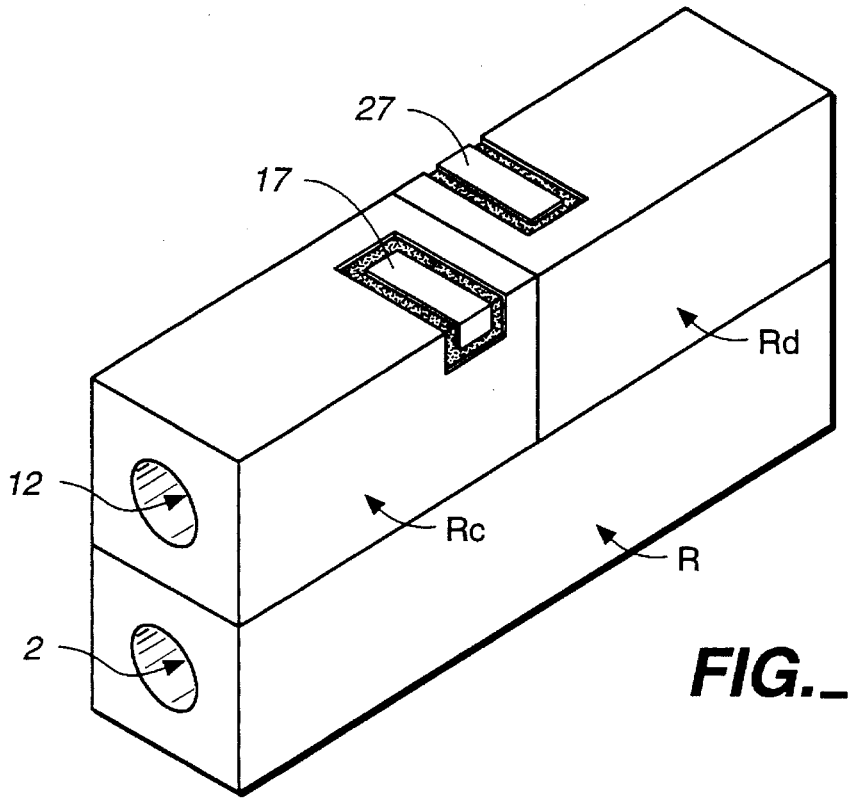
FIG. 5B is another external view of the same dielectric resonator apparatus taken diagonally from below.
Figure 6:
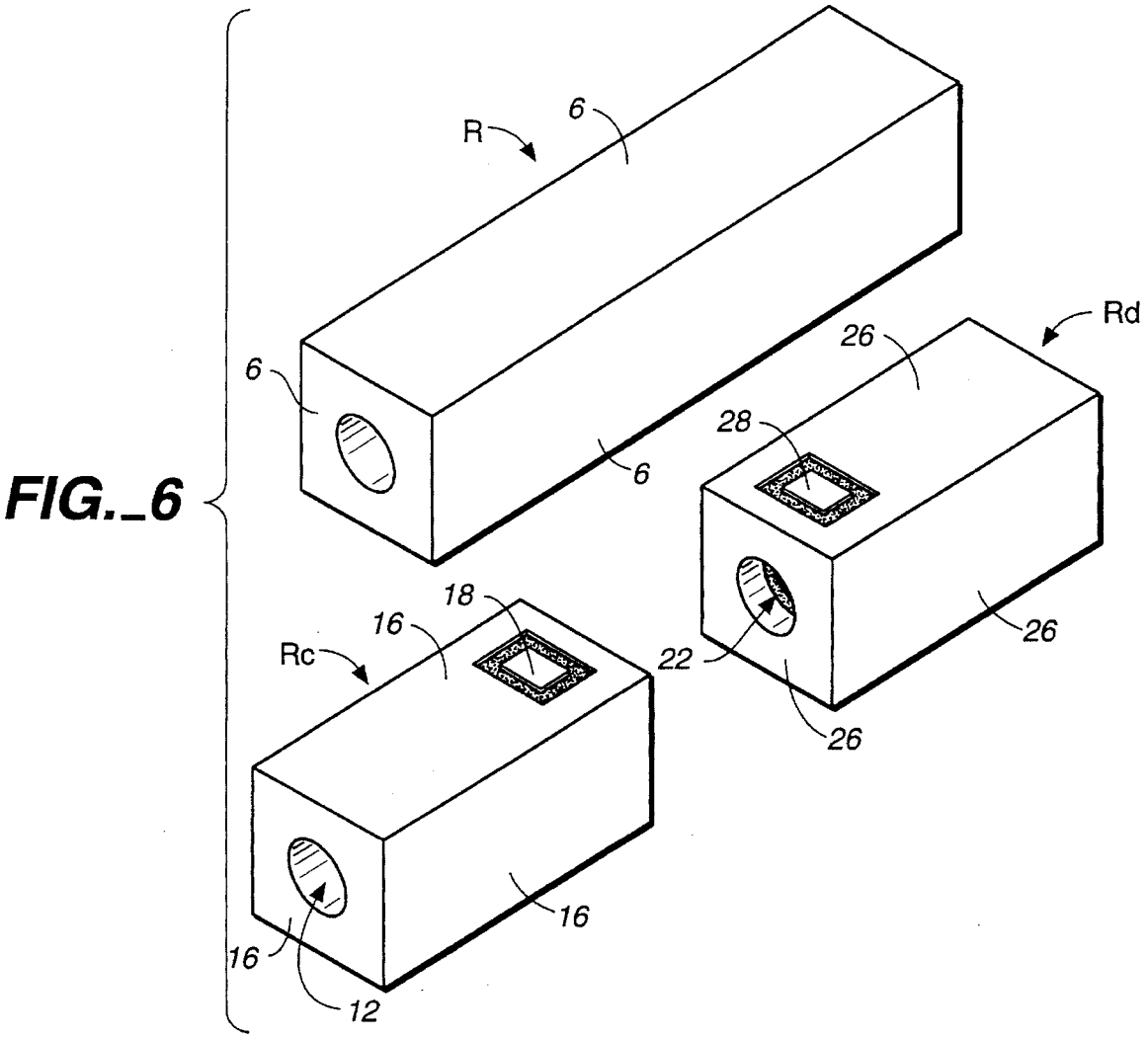
FIG. 6 is an exploded diagonal external view of the dielectric resonator apparatus of FIG. 5A.
Figure 7A:
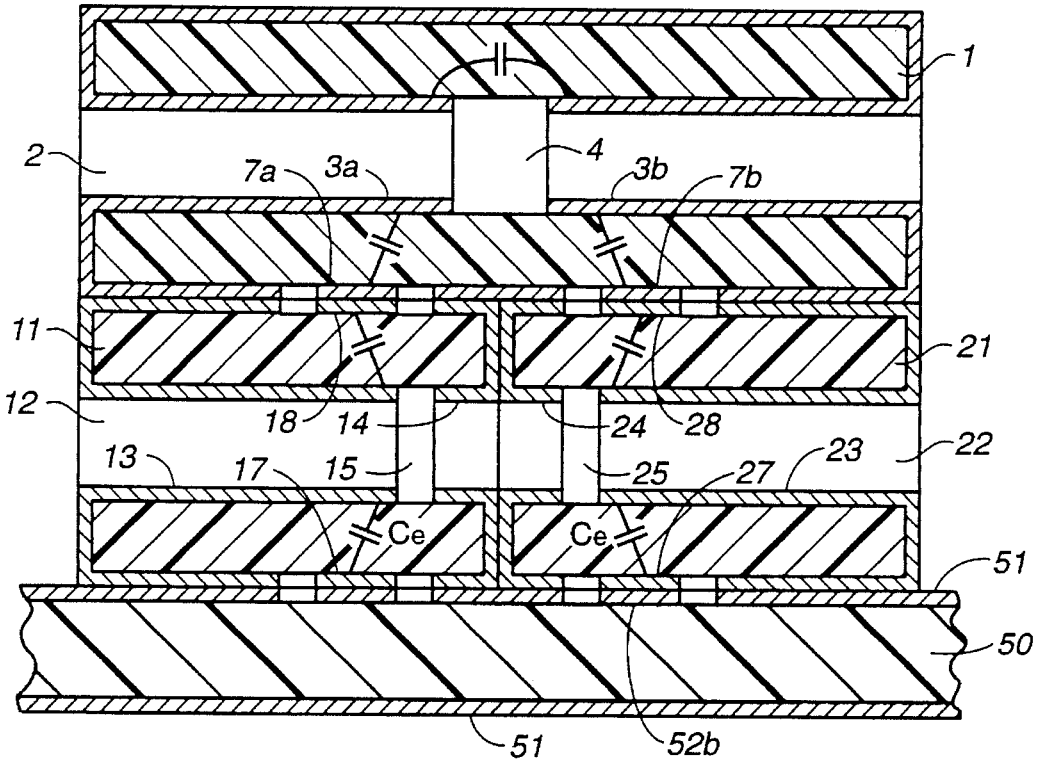
FIGS. 7A and 7B are schematic sectional views of the dielectric resonator apparatus of FIG. 5 taken respectively along lines VII-A—VII-A and VII-B—VII-B of FIG. 5.
Figure 7B:
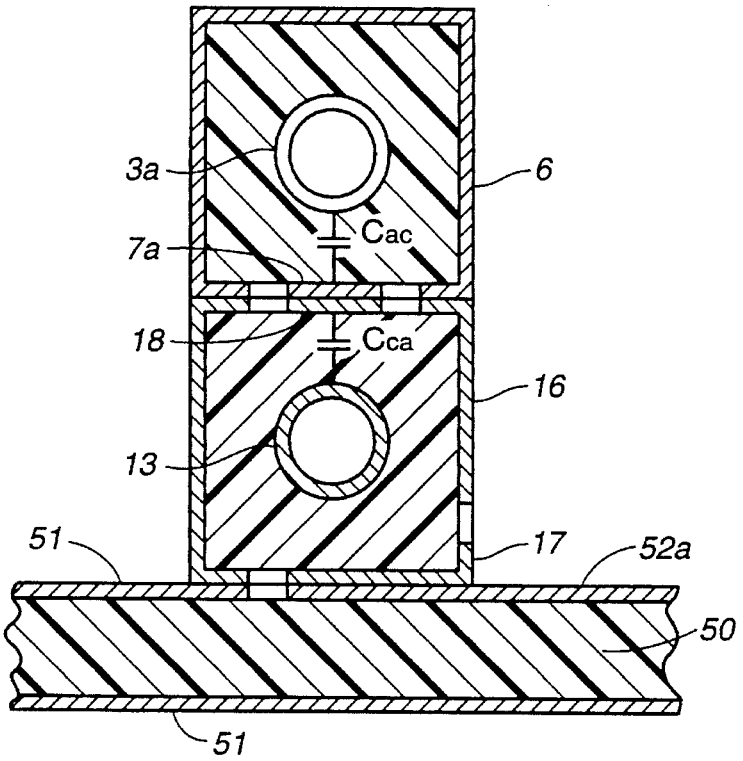

Described more in detail with reference to FIGS. 6 and 7, the dielectric resonators of the first kind $R_c$ and $R_d$ are each provided with a throughhole 12 or 22 respectively extending axially through dielectric blocks 11 and 21 both in the shape of a rectangular parallelopiped. Outer conductors 16 and 26 are formed on the external surfaces of the dielectric blocks 11 and 21, respectively, and connectors 18 and 28 of a conductive material are also provided on their surfaces through which they are attached to the dielectric resonator of the second kind R, separated from and totally surrounded like islands by the outer conductors 16 and 26, respectively. Similarly, signal input/output terminals 17 and 27 are formed, as shown in FIGS. 5A and 5B, insulated from and completely surrounded by the outer conductors 16 and 26, respectively, over mutually adjacent two of the side surfaces of the dielectric blocks 11 and 21, respectively, including the bottom surfaces through which the resonators $R_c$ and $R_d$ of the first kind are intended to be mounted to a circuit board (shown at 50 in FIGS. 7A and 7B).

Tubular inner conductors 13 and 14 are formed inside the throughhole 12, separated from each other through an electrode-free region 15. Similarly, tubular inner conductors 23 and 24 are formed inside the throughhole 22, separated from each other through an electrode-free region 25. The inner conductors 13 and 23 are each designed to function as a resonant conductor, the other inner conductors 14 and 24 being connected to the outer conductors 16 and 26 through the end surfaces of the blocks 11 and 21, such that stray capacitance is generated between the inner conductors 13 and 14 as well as between the inner conductors 23 and 24. Capacitance is generated between open-circuit end portions of the inner conductors 13 and 23 near their open-circuit ends and the conductive connectors 18 and 28, respectively, and capacitance serving as external coupling capacity $C_e$ is generated between open-circuit end portions of the inner conductors 13 and 23 near their open-circuit ends and the signal input/output terminals 17 and 27. The electrode-free regions 4, 15 and 25 may be formed by inserting a rotary grindstone into each of the corresponding throughholes from the side of its open-circuit end surface and causing the grindstone to rotate while it is moved along the inner surface of the throughhole, thereby removing not only portions of the inner conductors but also portions of the dielectric material. The widths, shapes and positions of the electrode-free regions are adjusted so as to control the axial lengths of the inner conductors serving as resonant conductors as well as aforementioned stray capacitance. In this manner, the capacitance between the inner conductors and the conductive connectors or the signal input/output terminals can be adjusted and the degree of coupling between the resonators can be controlled. Such adjustments are carried out for each of the dielectric resonators, whenever it is necessary, after they are attached together to form a unistructural apparatus.

The circuit board 50 is typically provided with signal transfer lines 52*a* and 52*b* and grounding terminals 51. The signal input/output terminals 17 and 27 of the dielectric resonators are connected to the transfer lines 52*a* and 52*b* on the circuit board 50, and the outer conductors 6, 16 and 26 of the dielectric resonators are connected to the grounding terminals 51 of the circuit board 50. Thus, when the dielectric resonator apparatus is mounted to a circuit board, its resonators of the first and second kinds "stand" on the circuit board. Thus, the area required for the mounting can be reduced significantly.

Figure 8:
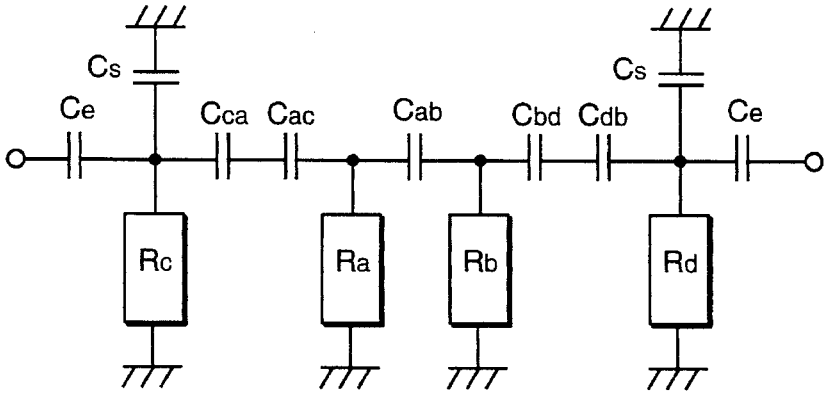
FIG. 8 is an equivalent circuit diagram of the dielectric resonator apparatus of FIG. 5.

FIG. 8 is an equivalent circuit diagram of the dielectric resonator apparatus described above with reference to FIGS. 5–7, wherein symbols R, $R_a$ and $R_b$ are as defined above, $C_{ca}$ indicates the capacitance between the inner conductor 13 and the conductive connector 18, $C_{ac}$ indicates the capacitance between the signal input/output terminal 7*a* (serving as connector) and the inner conductor 3*a*, $C_{bd}$ indicates the capacitance between the inner conductor 3*b* and the signal input/output terminal 7*b* (serving as connector), $C_{db}$ indicates the capacitance between the conductive connector 28 and the inner conductor 23, and $C_s$ indicates the stray capacitance between the inner conductors 13 and 14 and between inner conductors 23 and 24.

Figure 9A:
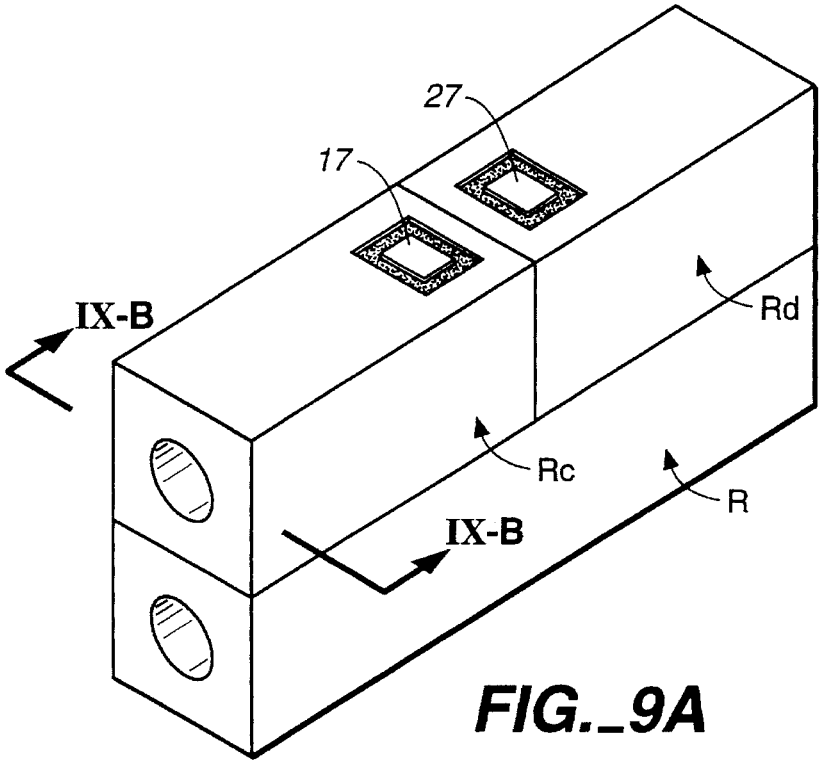
FIG. 9A is an external view of a dielectric resonator apparatus according to a fourth embodiment of the invention taken diagonally from below.
Figure 9B:
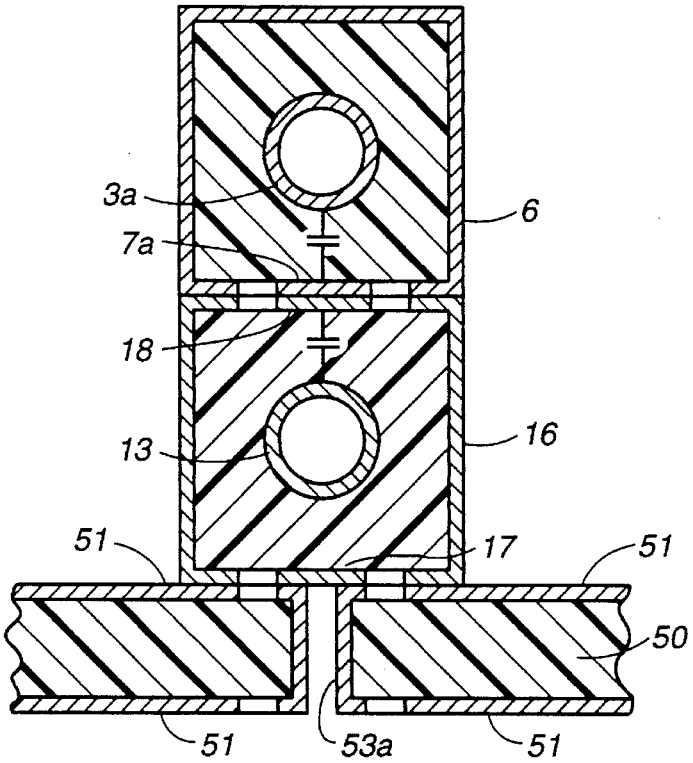
FIG. 9B is its schematic sectional view taken along line IX-B—IX-B in FIG. 9A.

FIGS. 9A and 9B show still another dielectric resonator apparatus according to a fourth embodiment of the invention, which is identical to the apparatus according to the third embodiment of the invention described above with reference to FIGS. 5–8 except that both signal input/output terminals 17 and 27 are formed exclusively on the bottom surface through which the apparatus is intended to be attached to a circuit board 50 such that they can be connected through a hole 53*a* in the circuit board 50 to a signal transfer line (not shown) formed on the opposite surface of the circuit board 50.

Figure 10A:
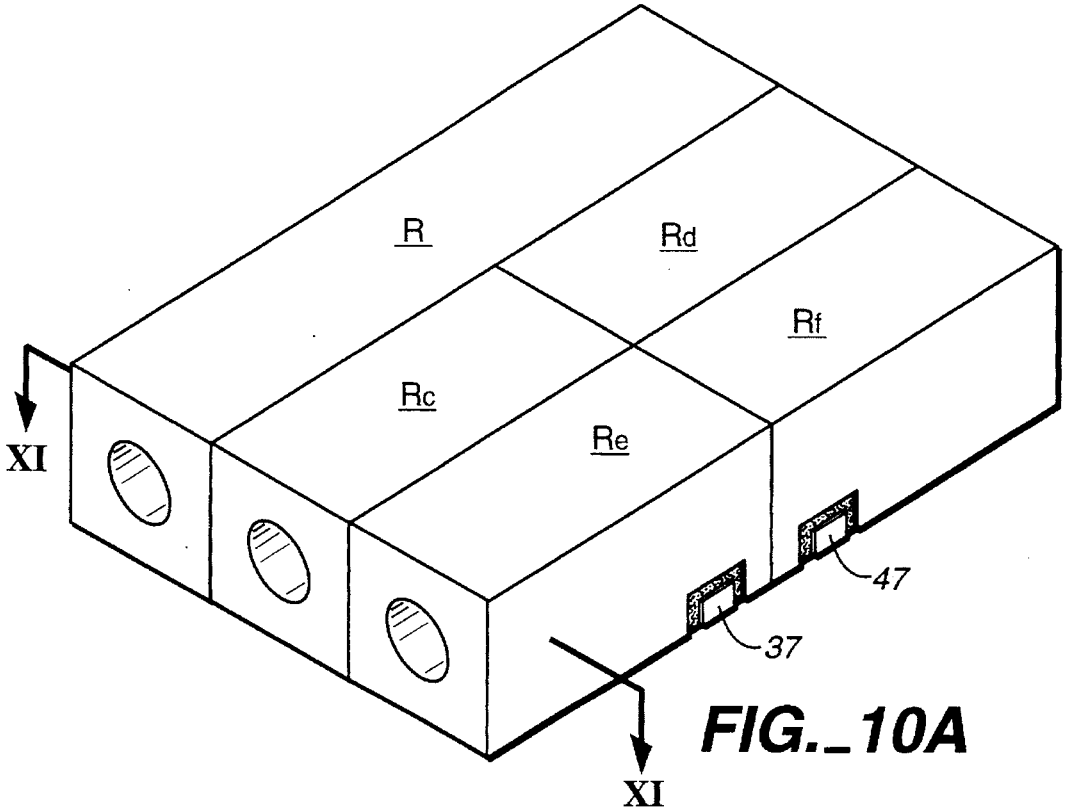
FIGS. 10A–(B) are external views of a dielectric resonator apparatus according to a fifth embodiment of the invention taken diagonally from above.
Figure 10B:
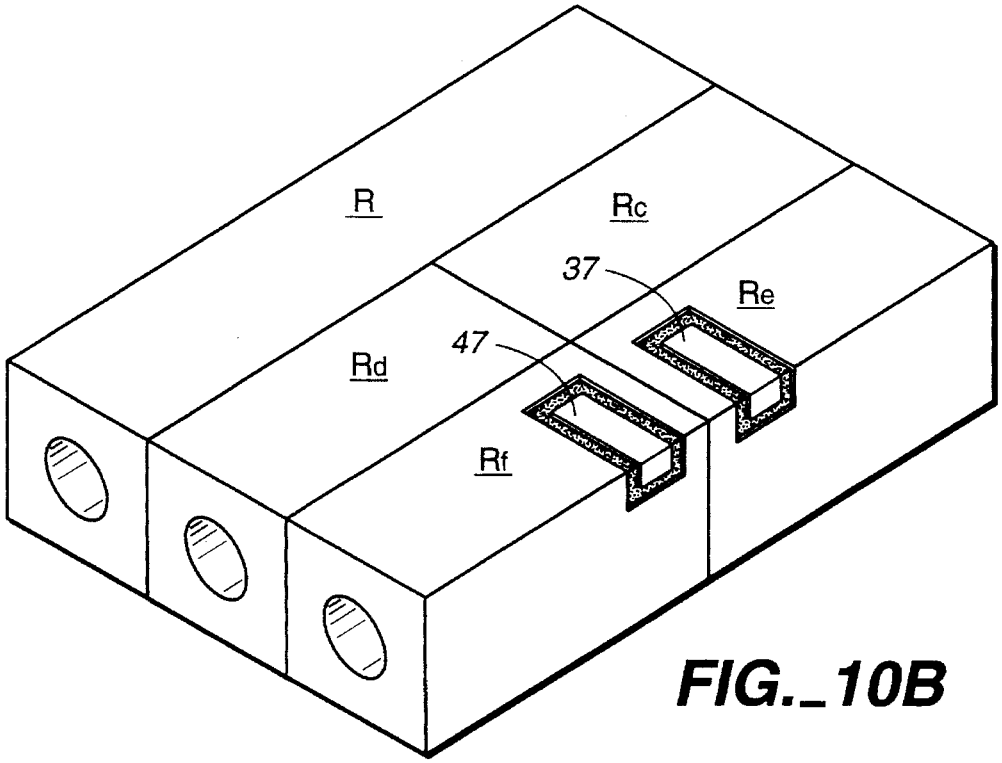
Figure 11:
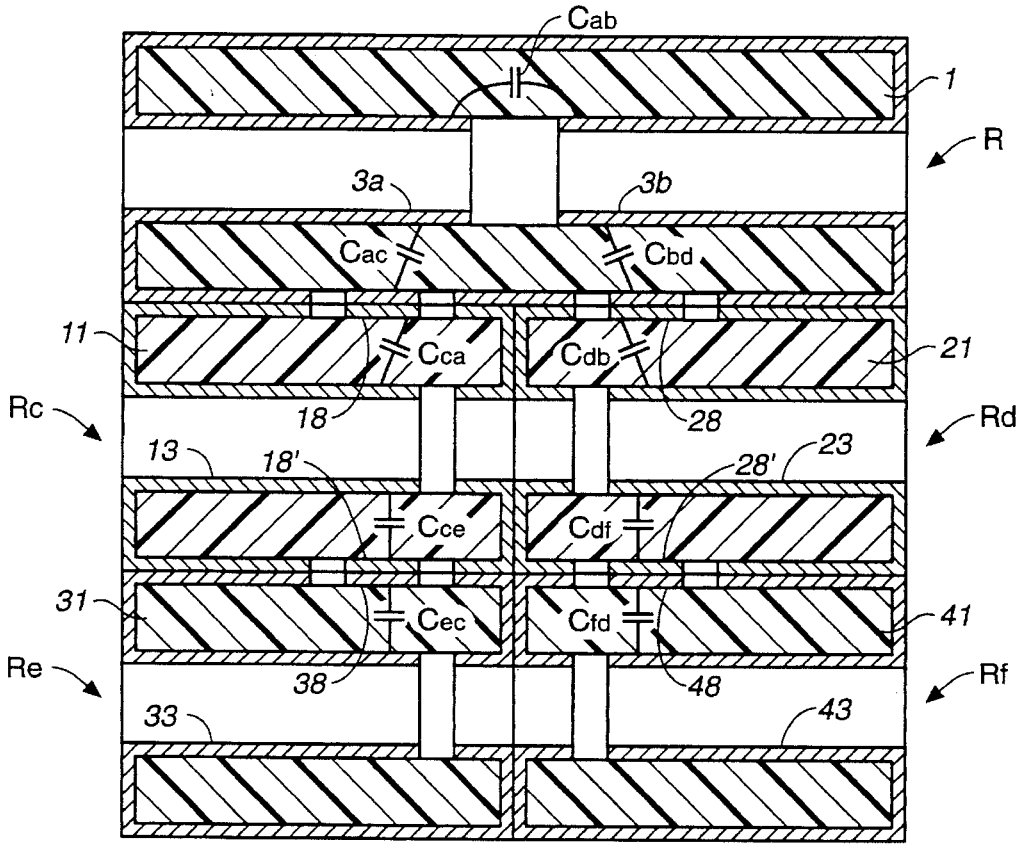
FIG. 11 is a schematic sectional view of the dielectric resonator apparatus of FIG. 10 taken along line XI—XI in FIG. 10A.
Figure 12:
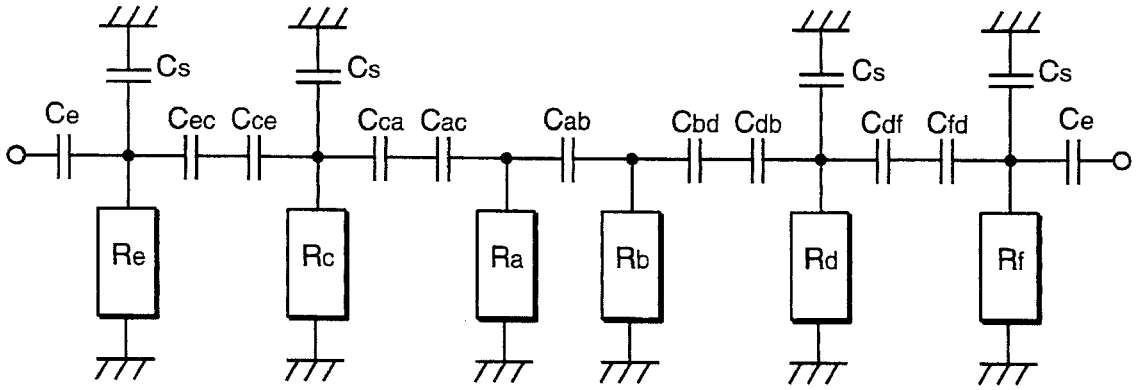
FIG. 12 is an equivalent circuit diagram of the dielectric resonator apparatus of FIGS. 10 and 11.

FIGS. 10–12 show still another dielectric resonator apparatus according to a fifth embodiment of the invention, wherein, as in FIG. 5, R indicates a structure essentially identical to the resonator apparatus shown in FIG. 1, or an dielectric resonator of the second kind according to this invention. $R_c$, $R_d$, $R_e$ and $R_f$ each indicate a dielectric resonator of the first kind, as described above with reference to FIGS. 5–7, functioning as a single-stage resonator. The resonators $R_c$ and $R_d$ are provided with conductive connectors 18, 18', 28 and 28', separated from the outer conductors thereon, on their contact planes with the structure R and the resonators $R_e$ and $R_f$, respectively. Similarly, the resonators $R_e$ and $R_f$ are provided with conductive connectors 38 and 48, separated from the outer conductors thereon, on their contact planes with the resonators $R_c$ and $R_d$, respectively. The resonators $R_e$ and $R_f$ are provided further with signal input/output terminals 37 and 47, respectively and separated and totally surrounded by the outer conductors thereon, as shown in FIG. 10B (not seen in FIG. 11).

As shown in FIG. 11, tubular inner conductors 13, 23, 33 and 43, each with an open-circuit end portion adjacent an open-circuit end not in contact with any other conductor, are formed on the inner surfaces of throughholes through dielectric blocks 11, 21, 31 and 41 of the resonators $R_c$, $R_d$, $R_e$ and $R_f$, respectively. Capacitances $C_{ca}$ and $C_{ce}$ are formed between the open-circuit end portion of the inner conductor 13 inside the resonator $R_c$ and the conductive connectors 18 and 18' provided thereon, and capacitances $C_{db}$ and $C_{df}$ are formed between the open-circuit end portion of the inner conductor 23 inside the resonator $R_d$ and the conductive connectors 28 and 28' provided thereon. Capacitance $C_{ec}$ is formed between the open-circuit end portion of the inner conductor 33 inside the resonator $R_e$ and the conductive connector 38 provided thereon, and capacitance $C_{fd}$ is formed between the open-circuit end portion of the inner conductor 43 inside the resonator $R_f$ and the conductive connector 48 provided thereon. The dielectric resonator apparatus thus structured with five dielectric resonators can function, for example, as a six-stage bandpass filter, as can be understood from the equivalent circuit diagram shown in FIG. 12.

Figure 13:
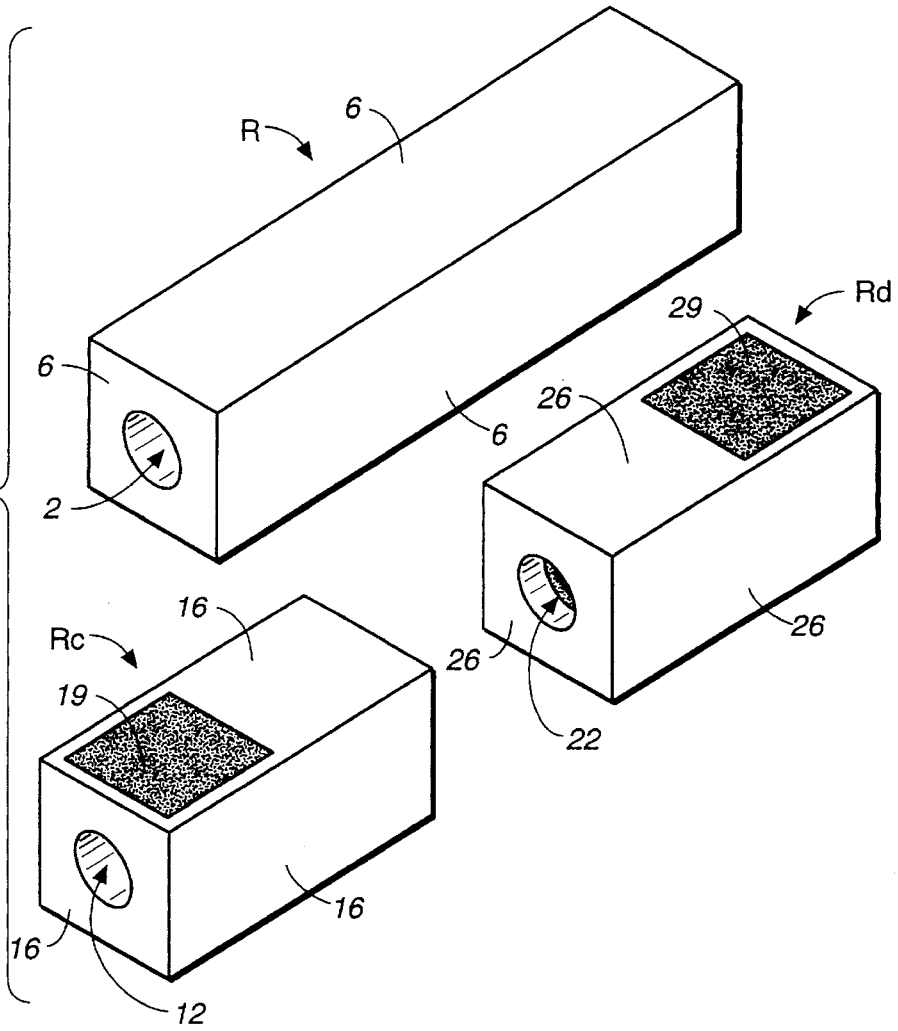
FIG. 13 is an exploded diagonal external view of a dielectric resonator apparatus according to a sixth embodiment of the invention.
Figure 14:
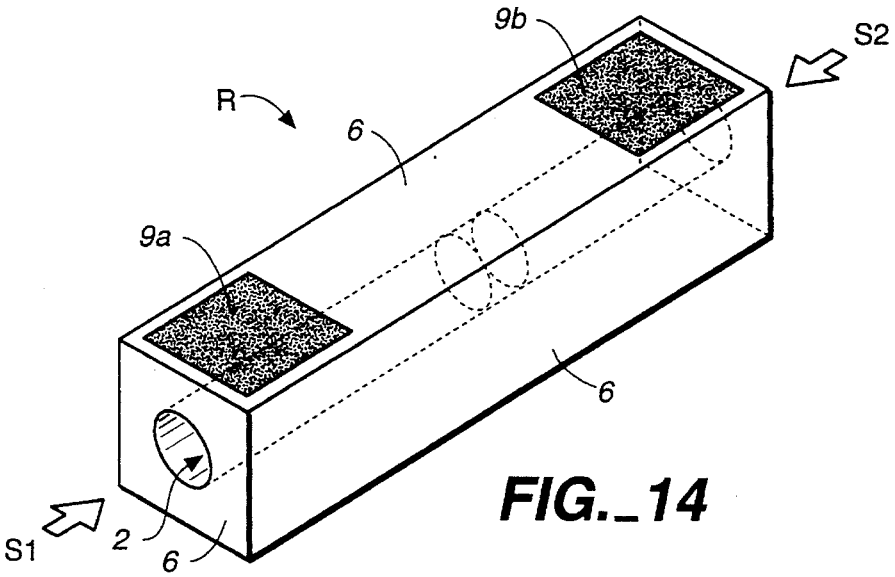
FIG. 14 is a diagonal external view of the bottom side of the structure R shown in FIG. 13.

FIGS. 13–15 show still another dielectric resonator apparatus according to a sixth embodiment of this invention, which is similar to the apparatus according to the third embodiment of the invention described above with reference to FIG. 6 but is different therefrom in that the resonators of the first kind $R_c$ and $R_d$ are coupled to the resonator of the second kind R magnetically, rather than capacitively. The resonators $R_c$ and $R_d$ according to this embodiment of the invention are provided, as shown in FIG. 13, with openings 19 and 29 in their outer conductors 16 and 26, respectively, on the surfaces across which they couple with the resonator R, and corresponding openings 9*a* and 9*b* are formed, as shown in FIG. 14, in the outer conductor 6 over the side surface of the resonator R across which the resonator R couples with the resonators $R_c$ and $R_d$ such that the openings 9*a* and 9*b* on the resonator R are opposite the openings 19 and 29 on the resonators $R_c$ and $R_d$. These openings 9*a*, 9*b*, 19 and 29 are formed near short-circuit end surfaces of the resonators R, $R_c$ and $R_d$, as shown in FIG. 15, where the magnetic field is the strongest. In this manner, the resonator R including the inner conductors 3*a* and 3*b* couple magnetically with the resonators $R_c$ and $R_d$ containing the inner conductors 13 and 23. As a whole, therefore, a dielectric resonator apparatus functioning, for example, as a four-stage bandpass filter is formed.

This invention has been described above with reference to only a limited number of examples, but these examples are intended to be illustrative, and not as limiting the scope of the invention. Many modifications and variations are possible within the scope of the invention. For example, more than two inner electrodes formed inside the throughhole of a resonator of the second kind may serve as a resonant conductor. Although dielectric resonators of the first kind are described above as having one end surface serving as a shorted surface and the other end surface as a "stray surface" and dielectric resonators of the second kind were described as having two short-circuit end surfaces, all these end surfaces may be open and the lengths of the inner conductors between their two open-circuit ends may be made approximately equal to one-quarter (for the first kind) or one-half (for the second kind) wavelength of the corresponding resonant frequency, as shown in FIGS. 16 and 17, respectively. In other words, dielectric resonators of the first and second kinds with inner conductors having two open-circuit end surfaces as shown in FIGS. 16 and 17 may be substituted appropriately into any of the apparatus described above, although such substituted apparatus are not individually illustrated or described.

As another example, although resonators of the first kind are all attached to the same side surface of a resonator of the second kind in all of the examples illustrated above, resonators of the first and/or second kind may be attached to different side surfaces of a resonator of a second kind. As a further example, inner conductors may not be formed inside throughholes reaching both end surfaces of a dielectric block. Inner conductors are only required to extend inside a cavity formed inside a dielectric block. In summary, dielectric resonator apparatus according to this invention have the advantages that the degree of freedom is increased in the choice of patterns on a circuit board to which they are to be mounted because use is made of only one dielectric block while a plurality of resonators are arranged. Dielectric resonator apparatus according to the third, fourth, fifth or sixth embodiments of this invention are advantageous in that, unlike prior art dielectric resonator apparatus, they do not require any shielding case or brackets for mounting. As a result, they can be made compact and their cost of manufacture can be reduced without requiring the use of many molds for the manufacture of resonator apparatus having different numbers of stages.

Another advantage of this invention is that resonant frequencies of the individual resonators of a resonator apparatus and the degrees of coupling between the resonators can be set and/or adjusted independently. If the axial lengths of the inner conductors of the resonators of the first kind in the third, fourth, fifth or sixth embodiment of the invention described above are made approximately twice that of the inner conductor of the resonator of the second kind, furthermore, many apparatus with a large number of stages can be compactly formed.

What is claimed is:

1. A dielectric resonator apparatus comprising:

a dielectric block having a first end surface and a second end surface which are opposite each other and side surfaces extending between said first and second end surfaces, a cavity being formed inside said dielectric block between said first and second end surfaces;

an outer conductor which is formed on said side surfaces and said first and second end surfaces and is connected to said inner conductors whereby said first and second end surfaces are shorted surfaces; and a plurality of axially elongated inner conductors each serving as a resonant conductor, sequentially extending axially inside said cavity between said first and second end surfaces, each mutually adjacent pair of said inner conductors being mutually separated by an electrode-free region and being coupled by capacitance generated in said electrode-free region.

2. The dielectric resonator apparatus of claim 1 further comprising a signal input/output terminals on one or more of said side surfaces and separated from said outer conductor, there being capacitance formed between said signal input/output terminals and said inner conductors.

3. The dielectric resonator apparatus of claim 1 having two inner conductors and two signal input/output terminals near a center portion of said one or more side surfaces, each of said signal input/output terminals forming a capacitance with different one of said inner conductors.

4. A dielectric resonator apparatus comprising a plurality of dielectric resonator of a first kind and a dielectric resonator of a second kind attached together to form a unistructural apparatus; each of said dielectric resonators comprising:

a dielectric block having a first end surface and a second end surface which are opposite each other and side surfaces extending between said first and second end surfaces, a cavity being formed inside said dielectric block;

an outer conductor formed on said side surfaces;

one or two axially elongated inner conductors each serving as a resonant conductor extending inside said cavity between said first and second end surfaces; and a coupling area at least on one of said side surfaces, said coupling area being of a kind selected from the group consisting of a magnetically coupling area and a coupling-providing conductor, said magnetically coupling area having said outer conductor formed with an opening through which said inner conductor couples magnetically with an adjacent one of said dielectric resonators, said coupling-providing conductor being insulated from and surrounded by said outer conductor and electrostatically couples with said inner conductor;

each of said dielectric resonators of the first kind having only one of said inner conductors serving as a resonant conductor and serving as a single-stage resonator; said dielectric resonator of the second kind having two inner conductors axially separated from each other by an electrode-free region therebetween, said two inner conductors being coupled each other through a capacitance generated across said electrode-free region wherein said dielectric resonator of the second kind serves as a double-stage resonator.

5. The dielectric resonator apparatus of claim 4 having two of said dielectric resonators of the first kind attached to one of the side surfaces of said dielectric resonator of the second kind.

6. The dielectric resonator apparatus of claim 5 wherein each of said inner conductors has two open-circuit end portions axially opposite each other and not in contact with any conductors.

7. The dielectric resonator apparatus of claim 6 wherein a signal input-output terminal separated from the outer conductor is formed on an opposite side surface of at least one of said dielectric resonators of the first or second kind, said opposite side surface being parallel to the surface across which said dielectric resonators of the first and second kinds are attached to each other.

8. The dielectric resonator apparatus of claim 5 wherein the first and second end surfaces of the dielectric block of each of said dielectric resonator of the first kind are covered by the outer conductor thereof and serve as shorted surfaces, and wherein either the first or second end surface of the dielectric block of said dielectric resonator of the second kind is covered by the outer conductor thereof to serve as a shorted surface.

9. The dielectric resonator apparatus of claim 8 wherein a signal input-output terminal separated from the outer conductor is formed on an opposite side surface of at least one of said dielectric resonators of the first or second kind, said opposite side surface being parallel to the surface across which said dielectric resonators of the first and second kinds are attached to each other.

10. The dielectric resonator apparatus of claim 5 wherein the first and second end surfaces of the dielectric block of each of said dielectric resonator of the first kind are covered by the outer conductor thereof, and wherein either the first or second end surfaces of two of said dielectric resonators of the first kind are attached to each other.

11. The dielectric resonator apparatus of claim 10 wherein a signal input-output terminal separated from the outer conductor is formed on an opposite side surface of at least one of said dielectric resonators of the first or second kind, said opposite side surface being parallel to the surface across which said dielectric resonators of the first and second kinds are attached to each other.

12. The dielectric resonator apparatus of claim 5 wherein a signal input-output terminal separated from the outer conductor is formed on an opposite side surface of at least one of said dielectric resonators of the first or second kind, said opposite side surface being parallel to the surface across which said dielectric resonators of the first and second kinds are attached to each other.

13. The dielectric resonator apparatus of claim 4 wherein a plurality of said dielectric resonators of the first kind are arranged in two rows and attached sequentially to one of the side surfaces of said dielectric resonator of the second kind.

14. The dielectric resonator apparatus of claim 13 wherein the first and second end surfaces of the dielectric block of each of said dielectric resonator of the first kind are covered by the outer conductor thereof, and wherein either the first or second end surfaces of two of said dielectric resonators of the first kind are attached to each other.

15. The dielectric resonator apparatus of claim 14 wherein a signal input-output terminal separated from the outer conductor is formed on an opposite side surface of at least one of said dielectric resonators of the first or second kind, said opposite side surface being parallel to the surface across which said dielectric resonators of the first and second kinds are attached to each other.

16. The dielectric resonator apparatus of claim 13 wherein each of said inner conductors has two open-circuit end portions axially opposite each other and not in contact with any conductors.

17. The dielectric resonator apparatus of claim 16 wherein a signal input-output terminal separated from the outer conductor is formed on an opposite side surface of at least one of said dielectric resonators of the first or second kind, said opposite side surface being parallel to the surface across which said dielectric resonators of the first and second kinds are attached to each other.

18. The dielectric resonator apparatus of claim 13 wherein the first and second end surfaces of the dielectric block of each of said dielectric resonator of the first kind are covered by the outer conductor thereof and serve as shorted surfaces, and wherein either the first or second end surface of the dielectric block of said dielectric resonator of the second kind is covered by the outer conductor thereof to serve as a shorted surface.

19. The dielectric resonator apparatus of claim 18 wherein a signal input-output terminal separated from the outer conductor is formed on an opposite side surface of at least one of said dielectric resonators of the first or second kind, said opposite side surface being parallel to the surface across which said dielectric resonators of the first and second kinds are attached to each other.

20. The dielectric resonator apparatus of claim 13 wherein a signal input-output terminal separated from the outer conductor is formed on an opposite side surface of at least one of said dielectric resonators of the first or second kind, said opposite side surface being parallel to the surface across which said dielectric resonators of the first and second kinds are attached to each other.

* * * * *